US006644488B1

(12) United States Patent
Coleman

(10) Patent No.: US 6,644,488 B1
(45) Date of Patent: Nov. 11, 2003

(54) COMBINATION GUM AND MINT CADDY

(76) Inventor: June L. Coleman, 555 John Muir Dr., #416, San Francisco, CA (US) 94132

( * ) Notice: Subject to any disclaimer, the term of this patent is extended or adjusted under 35 U.S.C. 154(b) by 0 days.

(21) Appl. No.: 09/833,885

(22) Filed: Apr. 12, 2001

Related U.S. Application Data

(60) Provisional application No. 60/197,212, filed on Apr. 14, 2000.

(51) Int. Cl.[7] ..... B65D 21/02

(52) U.S. Cl. ..... 220/23.4; 206/800; 220/524

(58) Field of Search ..... 220/23.4, 524; 200/800

(56) References Cited

U.S. PATENT DOCUMENTS

| | | | | | |
|---|---|---|---|---|---|
| 404,984 | A | * | 6/1889 | Robinson | 217/57 |
| 969,329 | A | | 9/1910 | Blake | |
| 1,028,888 | A | | 6/1912 | Krohn | |
| 1,052,594 | A | | 2/1913 | Krohn | |
| 1,155,791 | A | | 10/1915 | Cabell | |
| 1,459,257 | A | * | 6/1923 | Reger | 220/524 |
| 1,471,793 | A | * | 10/1923 | Israel | 206/229 |
| 1,598,441 | A | | 8/1926 | Haxton | |
| 1,666,095 | A | | 4/1928 | Jackson | |
| 2,747,388 | A | * | 5/1956 | Dolar | 217/57 |
| 3,397,818 | A | | 8/1968 | Rev | |
| 4,133,445 | A | * | 1/1979 | Mandelbaum | 206/504 |
| 4,170,914 | A | | 10/1979 | Carrier | |
| 4,399,913 | A | * | 8/1983 | Gelardi et al. | 206/387.12 |
| 4,465,208 | A | | 8/1984 | Buban | |
| 4,613,041 | A | * | 9/1986 | Carlton | 206/373 |
| 5,004,106 | A | * | 4/1991 | Blumstock et al. | 206/581 |
| 5,050,755 | A | * | 9/1991 | Strawder | 220/23.4 |
| 5,129,535 | A | * | 7/1992 | Hradisky | 220/23.4 |
| 5,353,956 | A | | 10/1994 | Wilson | |
| 5,370,219 | A | | 12/1994 | Violett | |
| 5,381,916 | A | * | 1/1995 | Strawder | 220/212 |
| 5,392,916 | A | * | 2/1995 | Paulison | 206/515 |
| 5,456,382 | A | | 10/1995 | Gringer | |
| 5,636,732 | A | | 6/1997 | Gilels et al. | |
| D383,062 | S | | 9/1997 | Gilels | |
| 5,676,243 | A | | 10/1997 | Sanders | |
| D390,459 | S | | 2/1998 | King | |
| D391,810 | S | | 3/1998 | Cooper | |
| 5,795,546 | A | | 8/1998 | Amelung | |
| 5,806,670 | A | * | 9/1998 | Harlan et al. | 116/67 R |
| 5,810,192 | A | * | 9/1998 | Cruz | 220/475 |
| D406,496 | S | | 3/1999 | Medina | |
| 5,890,613 | A | * | 4/1999 | Williams | 220/23.4 |
| D412,279 | S | | 7/1999 | Brice | |

OTHER PUBLICATIONS

Fruit Blast Bubble Gum container photograph, photo1.gif, date unknown, Leaf Inc., Lake Forest, IL.

Bubble Beeper Bubble Gum container photograph, photo2.gif, date unknown, Amurol Confections Company, Yorkville, IL.

Computer Bubble Gum container photgraph, photo3.gif, date unknown, manufacturer unknown.

* cited by examiner

*Primary Examiner*—Joseph M. Moy
(74) *Attorney, Agent, or Firm*—Basch & Nickerson LLP; Duane C. Basch

(57) ABSTRACT

The present invention is an apparatus for carrying gum and mints in separate compartments thereof. The gum and mint caddy is preferably constructed with a plurality of compartments, one or more of which are separable from the other so as to allow a user to carry gum, mints or both gum and mints. The caddy includes locking, resealable lids, and an adjustable inner lid and alignment mechanism to allow the gum compartment to be used with a plurality of gum package sizes (e.g., different stick quantities). The various components of the caddy are preferably made from a plastic or similar thermosetting material so as to provide durability during normal use

22 Claims, 7 Drawing Sheets

COMBINATION GUM AND MINT CADDY

CROSS REFERENCE

Priority is claimed from the following Provisional Application for Patent, which is hereby incorporated by reference for its teachings: "COMBINATION GUM AND MINT CADDY," June L. Coleman, Dr. P.H., application Ser. No. 60/197,212, filed Apr. 14, 2000.

This invention relates generally to a container for gum and mints, and more particularly to a caddy for carrying gum and mints in separate compartments thereof, wherein the container is adaptable to the preference of the user, being able to store gum and mints from different sized packages and of different shapes.

BACKGROUND AND SUMMARY OF THE INVENTION

The present invention is a multi-compartment caddy for carrying gum and mints in separate compartments thereof. The invention further includes features that allow the caddy to be constructed of a plurality of compartments, one or more of which are separable from the other(s) so as to allow a user to carry gum, mints, both gum and mints, or assorted combinations of gum and mint varieties. The caddy includes locking lids, and an adjustable inner lid and an alignment mechanism to allow the gum compartment to be used with a plurality of gum package sizes (e.g., different stick quantities). The various components of the caddy are preferably made from a plastic or similar thermosetting or thermoforming material so as to provide durability during normal use.

Heretofore, a number of patents and publications have disclosed various containers for storing gum and/or mints, the relevant portions of which may be briefly summarized as follows:

U.S. Design Pat. No. 412,279 is a design patent that illustrates a chewing gum protective container having an elongated compartment attached to a lid by flexible hinges. The container also has interlocking mechanisms for holding the lid closed, requiring the user to apply force to the lid in order to open the container. U.S. Design Pat. No. 406,496 illustrates yet another chewing gum container that incorporates a pin-type hinge to attach the lid to the elongated compartment. U.S. Design Pat. No. 390,459 is for a chewing gum pack holder that includes a cover attached by a flexible hinge to the elongated compartment.

U.S. Pat. No. 3,397,818 describes a package for chewing gum, etc., including both a resilient, spring-like member and a series of parallel ridges along one wall of the container. However, the parallel ridges are not found on opposing walls of the container, but along only one wall. The function of the ridges appears to be to offset the sticks of gum from the wall so as to allow the sticks to advance completely to the top of the container where they can be pushed out of the container. The function of the ridge is not to maintain the sticks in the container as to do so would be contrary to the described intent of allowing the sticks to move toward the top of the container under force applied by the spring-like member.

U.S. Pat. No. 5,636,732 describes a "cap" that can be placed over a gum package. U.S. Design Pat. No. 391,810 depicts a dual-cavity container with separate lids and a clip that attaches over a belt or strap. Other patents include U.S. Design Pat. No. 383,062, U.S. Pat. No. 5,456,382, U.S. Pat. No. 5,795,546 and U.S. U.S. Pat. No. 5,676,243.

A number of current products include a hinged, resealable lid, where a tab/recess locking mechanism is used to assure that the lid stays sealed until force is applied at or near the locking mechanism. Product examples include: Fruit Blast Bubble Gum, sold by LEAF, Inc. of Lake Forest, Ill.; Bubble Beeper Bubble Gum sold by Amurol Confections Company, Yorkville, Ill., and Computer Bubble Gum (seller unknown).

On the other hand, the present invention is an improvement over the original packaging, allowing both gum and mints to be stored in separate yet associated containers having a unique design, to both preserve the freshness of the gum and mints, and to allow the items to easily be found in a purse, pocket or other article of clothing, storage compartment (e.g., glove box of an automobile), etc.

In accordance with the present invention, there is provided a storage container, comprising: a first container portion including a plurality of walls and a base that define a first elongated compartment suitable for storing a plurality of stick-shaped condiments; a hinged lid for said first container, wherein said lid substantially covers a top of said first container when closed; a second container, releasably affixed to said first container, wherein said second container includes at least one wall and a base that define a second compartment suitable for storing a plurality of small items therein; and a second lid for said second container, said second lid being operatively associated with said second container so as to retain the plurality of small items within the second compartment when said second lid is closed.

In accordance with another aspect of the present invention, there is provided a combination gum and mint storage container, comprising: a gum container portion including a plurality of walls and a base that define a first elongated compartment suitable for storing a plurality of sticks of chewing gum therein; a hinged lid for said gum container, wherein said lid substantially covers a top of said gum container when closed; a mint container, releasably affixed to said gum container, wherein said mint container includes a plurality of walls and a base that define a second compartment suitable for storing a plurality of mints therein; and a second lid for said mint container, said second lid being operatively associated with said mint container so as to retain the mints within the second compartment when said second lid is closed.

In accordance with yet another aspect of the present invention, there is provided a combination gum and mint storage apparatus, comprising: a gum container including an elongated rectangular compartment suitable for storing a plurality of sticks of chewing gum therein and a lid for substantially covering a top of the elongated rectangular compartment; a mint container including a second compartment suitable for storing a plurality of mints therein and a second lid for substantially covering the top of the second compartment when closed; and wherein the mint container and the gum container are releasably affixed to one another.

One aspect of the invention deals with a basic problem in the storage and carrying of breath-freshening gum and/or mints. Often the as-sold packaging for the gum and mints is not durable enough to be stored for long periods of time in a purse, pocket, or otherwise carried by a person. Storage in original packaging results in the loss of freshness (for gum) and enhances the potential for the gum or mints to spill or scatter after the packaging is initially opened, particularly within a pocket or purse. Moreover, although often used for a common breath-freshening purpose, the gum and mints are seldom found in the same place This aspect is further based on the discovery of a re-usable gum and mint caddy that alleviates this problem. The container system preferably includes at least a pair of compartments in which gum and mints may be separately stored. Moreover, the compartment in which the gum is stored is designed so as to accommodate various chewing gum package sizes while retaining the sticks therein even after the package has been opened.

Figure 1:
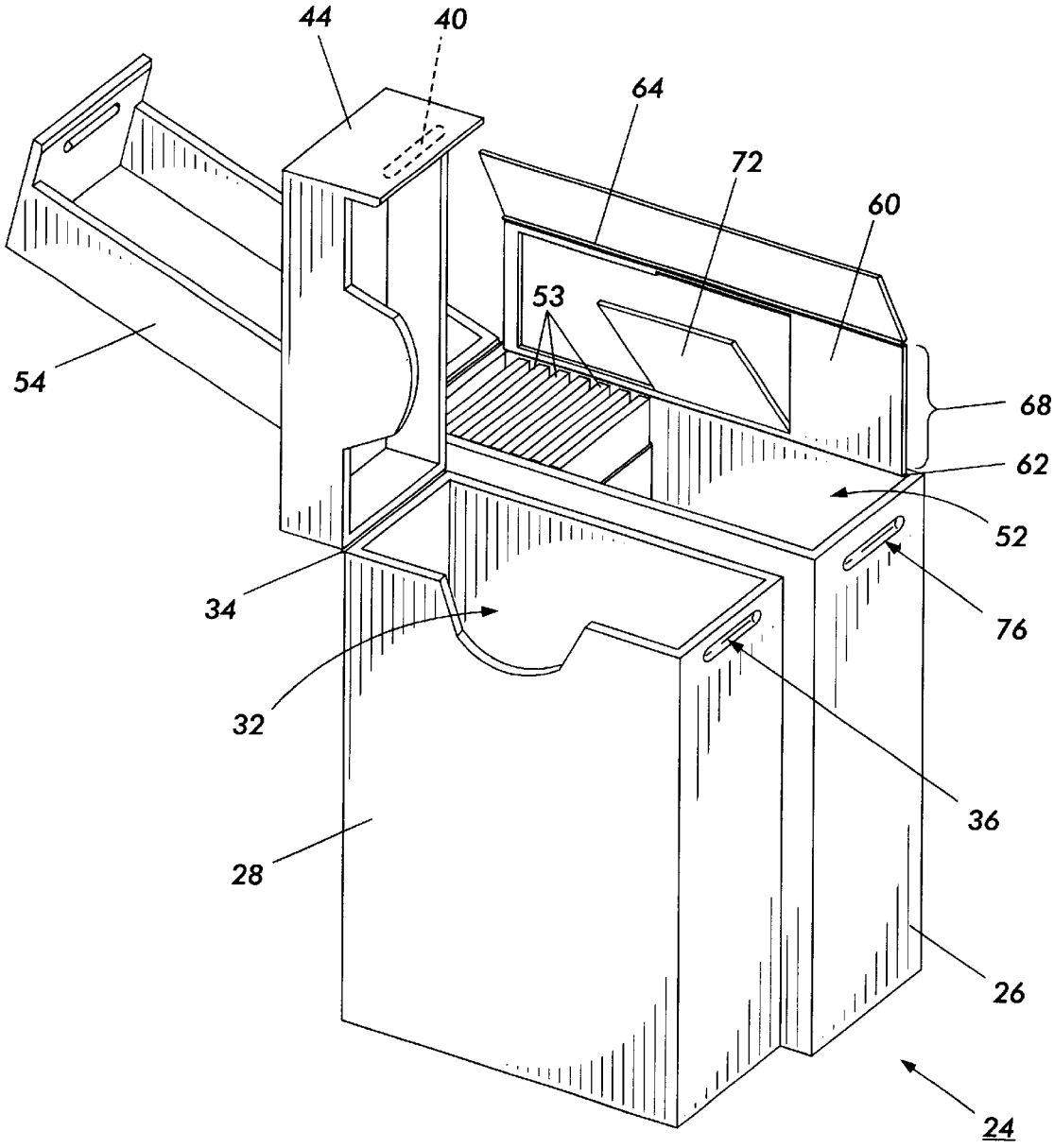
FIG. 1 is a perspective illustration of an embodiment of the present invention, showing the gum and mint containers in an attached configuration.

The present invention will be described in connection with a preferred embodiment, however, it will be understood that there is no intent to limit the invention to the embodiment described. On the contrary, the intent is to cover all alternatives, modifications, and equivalents as may be included within the spirit and scope of the invention as defined by the appended claims.

DESCRIPTION OF THE PREFERRED EMBODIMENT

For a general understanding of the present invention, reference is made to the drawings. In the drawings, like reference numerals have been used throughout to designate identical elements.

Referring to FIG. 1, illustrated therein is a perspective view of an embodiment of the combination gum and mint caddy 24. In particular, FIG. 1 shows the gum container 26 and a somewhat smaller mint container 28 in an attached configuration that comprises the caddy. In a preferred embodiment, mint container 28 includes a rectangular compartment 32 that is suitable for storing a plurality of loose mints (e.g., breath mints) or similarly sized candies, lozenges, etc. Although described herein as a compartment for holding: loose items, an alternative embodiment is also contemplated wherein the mint compartment 32 is of a size suitable to enclose such items and their original packaging. Mint container 28 further includes a lid 34 that is hinged on one edge of the compartment. Hinge 34 is preferably a molded or "living" hinge formed from the same material as the balance of the mint compartment. Alternative hinge designs with pivots, are also contemplated although not shown.

Various materials may be employed in forming mint container 28 and its hinged lid, including metals, plastics, fabrics, etc. A preferred embodiment uses a polymer (including thermosetting or thermoforming) such as polypropylene that may be injection molded. Furthermore, the thickness of the walls of the mint container are generally on the order of 0.030 inches in thickness, although a thickness in the range of 0.015–0.15 inches and thicker may be suitable. It will be further appreciated that the materials and molding techniques employed can determine the surface texture of the container, the color and translucency thereof as well as other characteristics.

Opposite the hinged side there is provided a locking mechanism 36. In the illustrated embodiment, mechanism 36 is comprised of a recess or depression 38 on the outer surface of the mint compartment wall. A mating ridge or similarly-shaped protrusion 40 is found in the interior surface of lid 36, preferably on a tab 44 that extends therefrom and is adjacent depression 38 when lid 36 closed. When the lid 36 is closed, the protrusion 40 positively "interferes" or "mates" with depression 38 and "locks" the lid closed. It will be appreciated by those skilled in the art of container tooling and mold design that the configuration described above may be reversed, and that various equivalent "locking" mechanisms exist to permit the lid 36 of the mint compartment to be maintained in a closed position. Included in the alternatives are various extending tabs having protrusions or ridges to interconnect with corresponding grooves, recesses and detents on the mating piece; snap-locks; as well as hook-and-loop fastening systems (e.g., various fastening systems sold under the name Velcro™).

Continuing with FIG. 1, gum compartment 26 preferably includes an elongated rectangular compartment 52 suitable for storing a plurality of sticks of gum 53 or similarly sized condiments. Although described herein as a compartment for holding sticks of gum within their original packaging, an alternative embodiment is also contemplated wherein the gum compartment 52 is of a size suitable to enclose such items when separated from their original packaging (including outer packaging and one or more layers of packaging for individual sticks of gum). Gum container 26 further includes an outer lid 54 that is preferably hinged along a short edge of the compartment. As with the mint container, the hinge (FIG. 2; 54) is likely a molded hinge formed from the same material as the gum container. The gum container 28, is preferably constructed from a similar material and in a similar fashion as described above with respect to the mint container 28.

It will be appreciated that the lid of one or both containers may be of differing designs, including generally planar lids, or lids having recesses therein. In either case, the lids are preferably formed along the edges thereof so as to mirror the shape of the upper edge of the compartments that are sealed. For example, upper edges may be flat, or may have a profile that is "mirrored" by the lid edges so as to provide a positive seal between the lid and the compartment.

Figure 6:
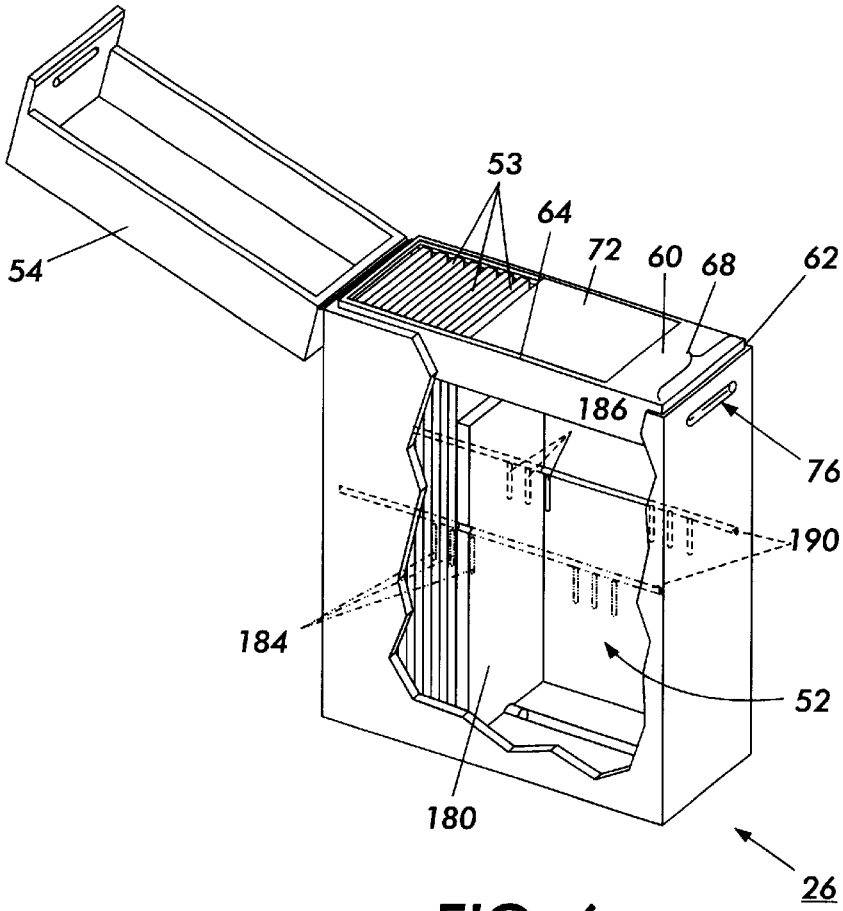
FIG. 6 is a detailed illustration of the various features if the gum container of FIG. 1, including a support.
Figure 7:
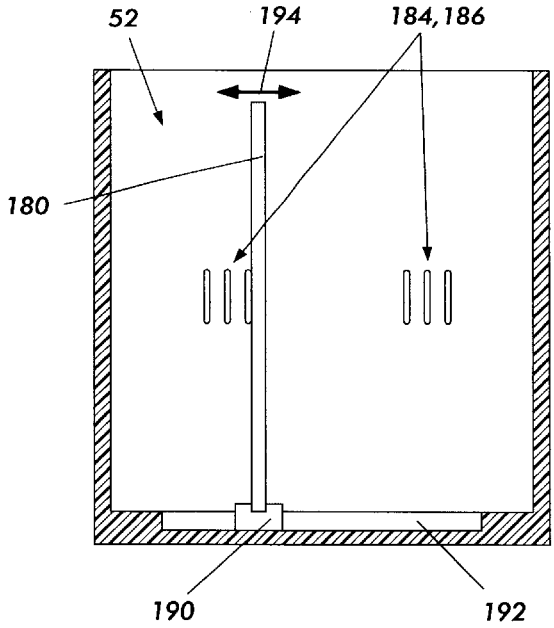
FIGS. 7–12 illustrate various embodiments for the gum-support of FIG. 6.
Figure 8:
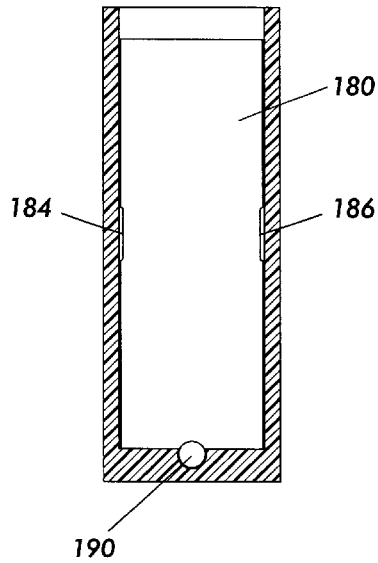
Figure 9:
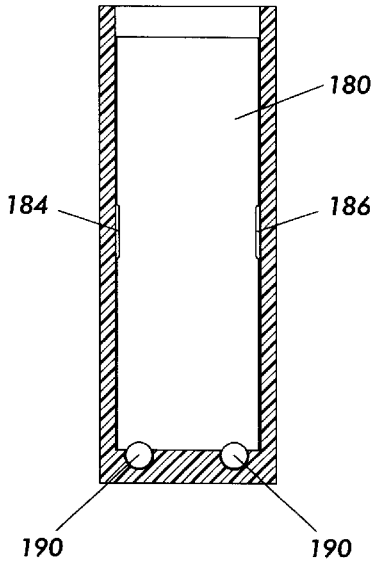

An additional optional feature of the gum container is inner lid 60. Inner lid 60 is designed to fold down within compartment 52 so as to hold gum packages of various sizes, and to secure the gum within the compartment 52. In particular, inner lid 60 folds or bends along lines 62 and 64 so that a center portion 68 forms a "top" within the gum compartment 52, even when the outer lid 54 is in an opened position. Inner lid 60 further includes a flap 72 that may be used to cover an open space in the compartment when a package with 7 or ten sticks is inserted into gum compartment 52. Alternatively, flap 72 may be tucked within the compartment when a 17 stick package of gum is inserted within the compartment. Once the gum is inserted within compartment 52, and inner lid 60 is folded down, then outer lid 54 may be swung into its closed position and "locked"

using a releasable locking mechanism 76 similar to that described with respect to the mint container 28. Another aspect of the gum compartment 52, as depicted in FIG. 6 (described below), is an adjustable support 180 for holding sticks of gum in an upright manner once separated from their original outer packaging.

Figure 2A:
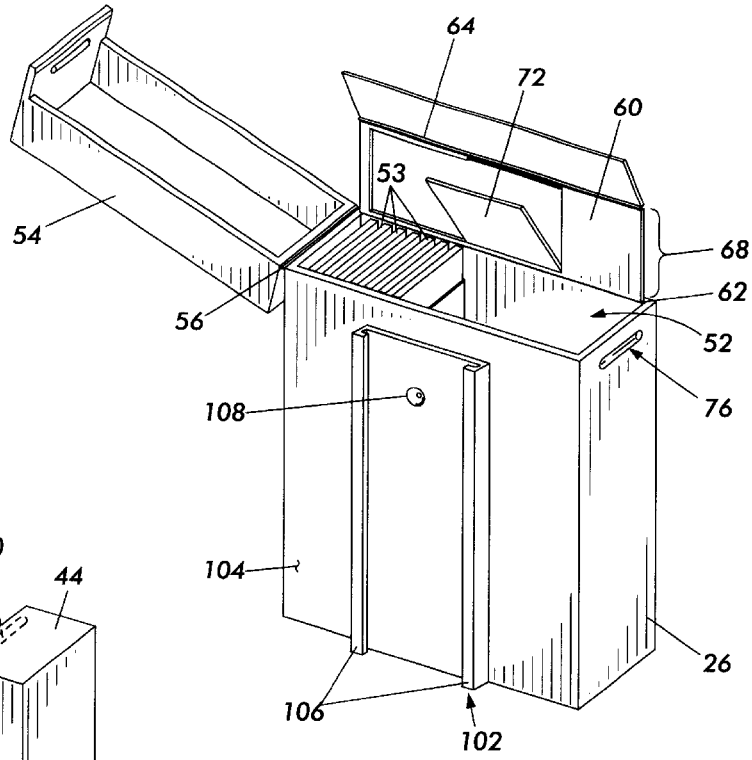
FIGS. 2A and 2B are, respectively, illustrations of the separated gum and mint containers of FIG. 1 with an illustration of a mating attachment mechanism.
Figure 2B:
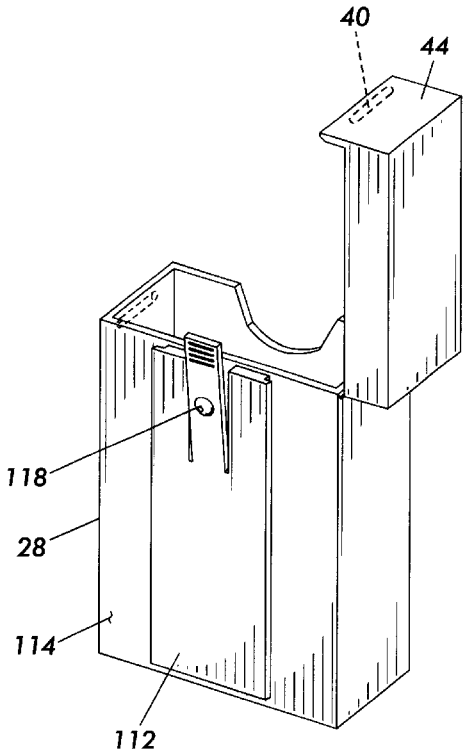

Referring next to FIGS. 2A and 2B there are illustrations of the separated gum and mint containers (26 and 28) of FIG. 1, so as to further depict a releasable attachment mechanism shared therebetween. In a preferred embodiment, containers 26 and 28 are releasably attached to one another, thereby allowing a user to conveniently carry one or both containers. In an alternative embodiment, the gum and mint containers may be releasably attached to one another using hook and loop type surfaces thereon or affixed thereto. For example, the gum container may have a hook-type surface on one side and the mint container a loop-type surface on the mating side. Moreover, it is anticipated that sales of the containers may be accomplished separately (in association with their contents), wherein a user may subsequently interconnect one or more of the containers.

Referring to FIG. 2A, the gum container 26 is illustrated with a slide-type rail system 102 on an outer surface of the front wall 104. In one embodiment, slide rail 102 includes a pair of parallel "rails" or channels 106 on either side thereof, and a recess or detent 108 at one end of the slide. As illustrated in FIG. 2B the slide 112 of the slide mechanism is preferably formed on the rear wall 114 of the mint container 28 and has shoulders (FIG. 3B; 114) that are engaged by rails 106. At the upper end of the mating portion 112 is a ridge, bump or protrusion 118 suitably positioned so that the protrusion positively engages the recess 108 when the two containers are attached using the slide-type channel.

Figure 3A:
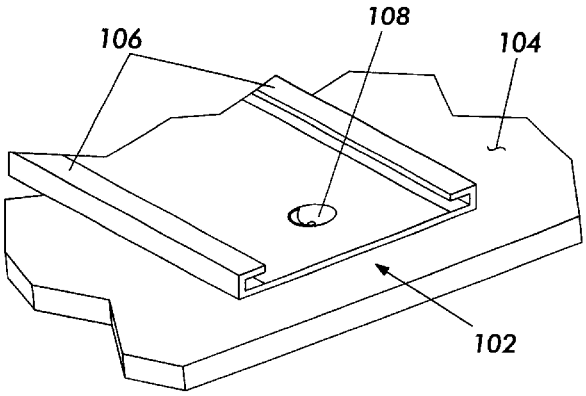
FIGS. 3A, 3B and 3C are detailed illustrations of an attachment mechanism as depicted in FIGS. 2A and 2B.
Figure 3B:
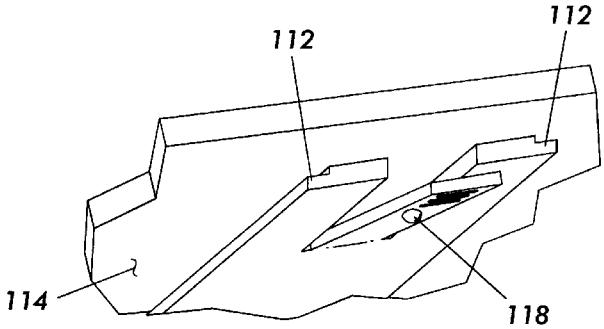
Figure 3C:
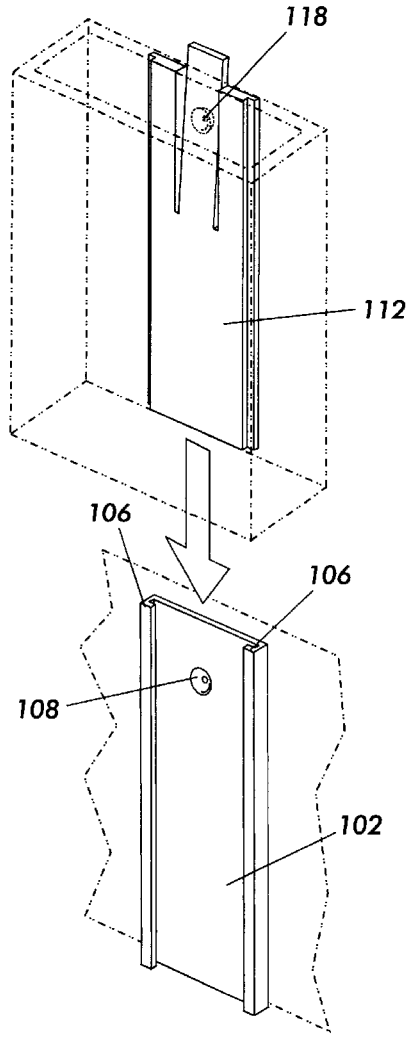

Referring to FIGS. 2A and 2B, in conjunction with FIGS. 3A–3C, the operation of the slidable attachment mechanism (102 and 112) will be described. In order to attach the gum and mint containers to one another, or to similarly designed containers, the bottom of the slide 112 is inserted into the top of rail 102 in the direction of the arrow in FIG. 3C. The shoulders 114 are then engaged by rails 106 and the two containers are only allowed to move relative to one another in a direction parallel to the rails/shoulders. To facilitate the shoulders engaging with the rails, it may be desirable to taper the leading edges of either or both of the shoulders and rails. Attachment of the containers is completed by continuing to slide the two containers relative with one another until the protrusion and recess are aligned and engaged, preferably when the bottoms of both containers are generally aligned or the gum container 26 extends slightly below the mint container 28.

Figure 4:
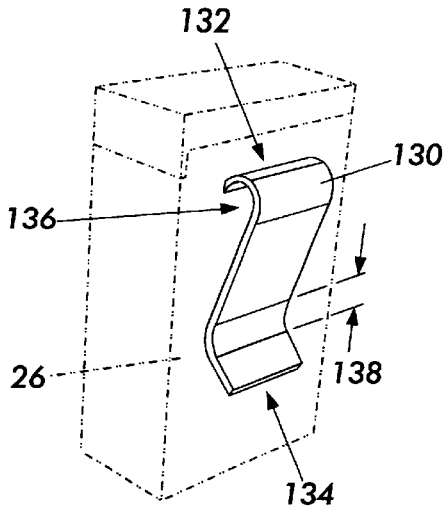
FIG. 4 is a perspective view of a clip attached to the rear of the gum container of FIG. 1.

Referring to FIG. 4, there is shown a perspective view of a clip 130 attached to the rear of gum container 26. In a preferred embodiment, clip 130 is of a curvilinear form wherein an upper end 132 is integrally attached to container 26, and a lower end 134 is separated from the container. Clip 130 is preferably formed or attached so as to provide a recess or opening between a portion of the clip and the rear wall of container 26, so as to allow the clip to slide over and engage a belt, strap, pocket, flap, visor or similar structure associated with or within convenient reach of a user. Furthermore the clip is flexibly biased against the rear wall of container 26 along the region indicated by reference numeral 138 so as to cause the clip to attach the container to the article or structure to which it is "clipped." In a preferred embodiment, clip 130 is integrally molded with the remainder of container 26. In an alternative embodiment, clip 130 may be produced separately, from various suitable materials such as plastics, metals, etc. and permanently affixed to the container using fasteners, adhesives or similar means.

Figure 5:
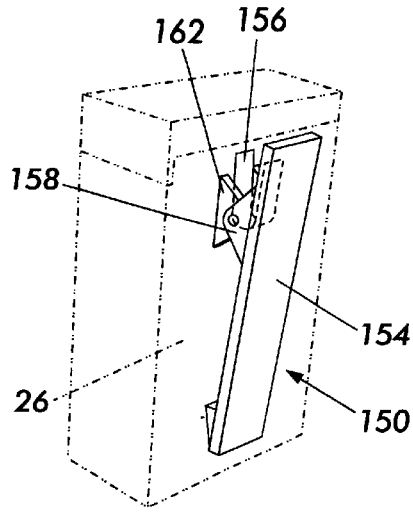
FIG. 5 is a perspective view of a spring-loaded clip attached to the rear of the gum container of FIG. 1.

Referring also to FIG. 5 there is shown an alternative spring-loaded clip 150, suitable for attaching the caddy to a belt, clothing, straps, pocket, flaps, visors or similar structures. In a preferred embodiment, clip 150 is formed using an injection molding technique, wherein the clip member 154 is molded as a substantially planar piece, with a spring-flap 156 extending from an upper portion thereof. On opposite sides of the planar clip member are a pair of pivot holes 158 that may be co-planar with the member, or offset slightly below the plane of the clip member. Pivot holes 158 are spaced-apart so as to intersect with a corresponding set of pivot points 162 that extend from the rear surface of the gum container 26. When the pivot holes of clip member 154 are press-fit between the pivot points 162, the clip member is retained therebetween, and the spring-flap 156 is flexibly biased against the rear surface of the container 26. The bias of spring-flap 26 causes the lower edge of clip member 154 to be biased toward the rear surface of the container, and to thereby frictionally affix the container to any material or structure to which it is clipped.

FIG. 6 is a detailed illustration of further features of gum container 26 of FIG. 1, and showing inner lid 60 in its "closed" position so as to conceal the compartment 52, except for the gum sticks. Depicted via the cutaway region in FIG. 6 is the presence of an interior support 180, wherein the support is maintained in a generally vertical orientation and is used to provide a "stop" or exert a slight force normal to the end of the vertical stack of chewing gum sticks 53. In one embodiment, the support 180 is maintained in a vertical position adjacent the end of the right-most stick 53 by a series of ridges or protrusions 184 and 186 that are similarly spaced and positioned on the opposite inner walls of container 26. The position of protrusions 184 and 186 are preferably designed so as to allow the support to be positioned for gum packages having 7,10 or 17 pieces.

Also illustrated in FIG. 6 are a pair of ridges 190 on the inside of the front and rear walls of the compartment 52. The ridges extend from the walls so as to interact with the vertical edges of the gum sticks 53. In a preferred embodiment, the ridges extend a sufficient distance to slightly resist the insertion of the gum sticks into the compartment 52, and thereby "hold" the gum within the container. This is preferred so as to prevent individual gum sticks and/or entire package of gum sticks from falling out when the caddy is inverted. Although illustrated as extending the entire length of the front and rear walls, it will be appreciated that the ridges need only extend through all or a portion of the area of the compartment where the sticks 53 are stored.

Referring to FIGS. 6–12, various configurations for the support are contemplated, particularly involving various means for slidably attaching the bottom of support 180 to the interior base of container 26. As illustrated in detail in FIGS. 7 and 8, support 180 may include a single cylindrical-shaped slide 190 that is able to slidably travel within a rail or groove 192 molded in the bottom of compartment 52. It will be appreciated that the flexible nature of certain materials may allow the forced insertion of the slide 190 into the groove 192 wherein the support is retained by the groove and constrained to slide in a direction indicated by arrow 194. As depicted by the alternative embodiment of FIG. 9, a plurality of slide/groove pairs may be employed to keep the support in a generally vertical orientation and parallel to the gum sticks 53.

In a further alternative embodiment for the gum and mint caddy 24, one or more exposed surfaces of the container may have a mirrored or reflective surface affixed thereto. In particular, it is contemplated that a mirror or equivalent reflective surface could be added to the interior surface of the respective lids on the gum and/or mint containers, 26 and 28, respectively. Moreover, the mirrored surface may be sold as an accessory for the gum and mint caddy 24, wherein a user could selectively insert the mirrored surface within one or both lids using a clip or adhesive strip affixed thereto.

Figure 10:
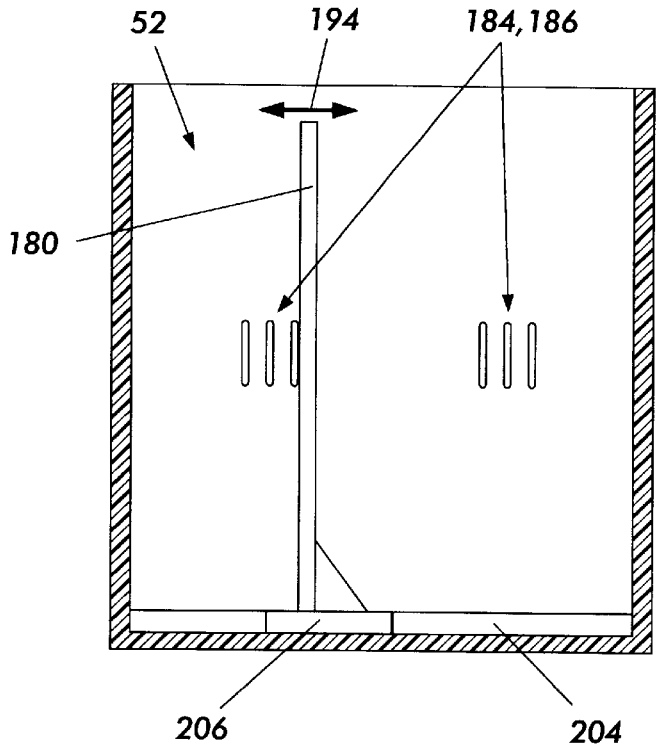
Figure 11:
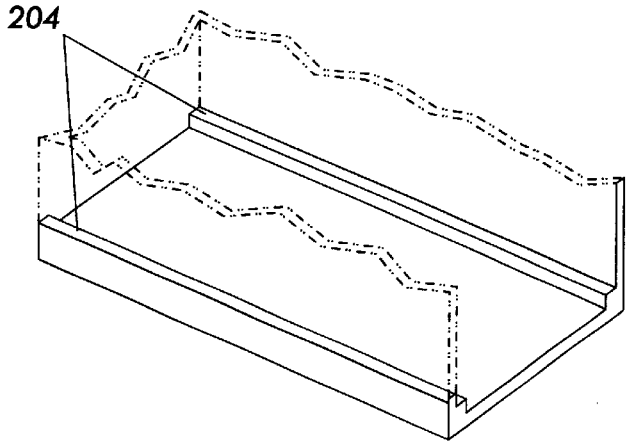
Figure 12:
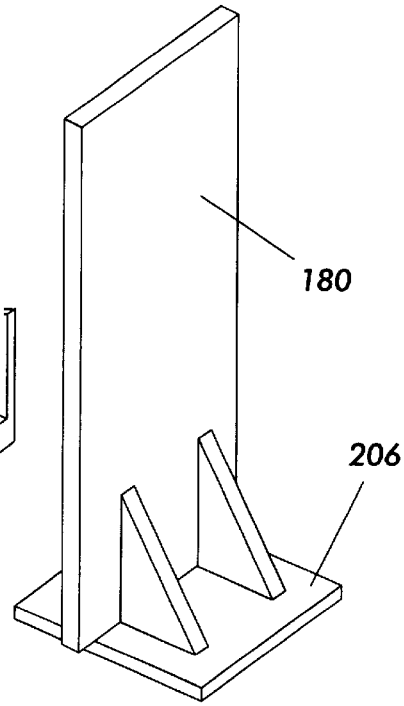

In yet another alternative embodiment illustrated in FIGS. 10–12, the bottom of compartment 52 may include a pair of rails or channels 204 that extend at least partially along the L-shaped corner defined by the front and back vertical walls and the base of the compartment. Within rails 204, a base 206 of the support 180 is constrained to move in the direction indicated by the arrow 194. Here again, the means for slidably attaching the support to the container is a base 206 that slides within the region defined by the channels 204. It will be appreciated that various equivalent alternatives may be employed for slidably attaching the support 180 to the container so as to provide a support 180 that is adjustable with respect to the number of sticks of gum stored in gum container 26

Figure 13:
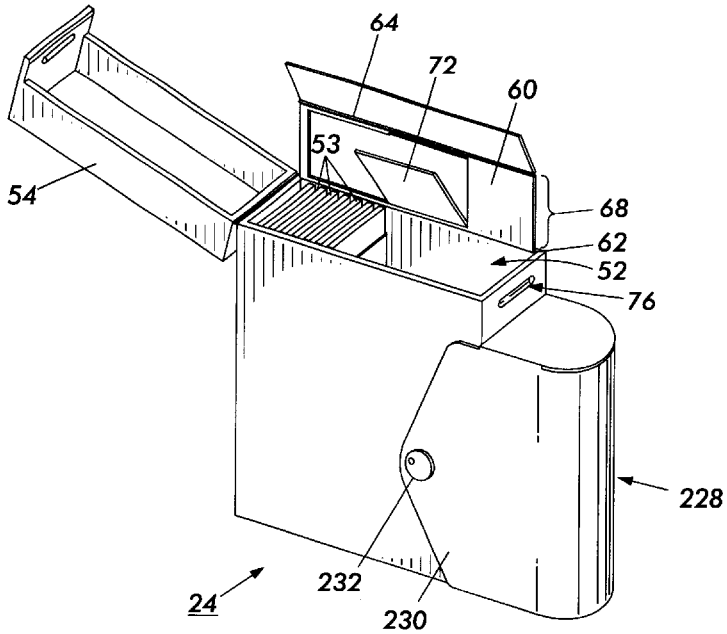
FIG. 13 depicts an alternative embodiment for the combination gum and mint caddy in accordance with the present invention.
Figure 14:
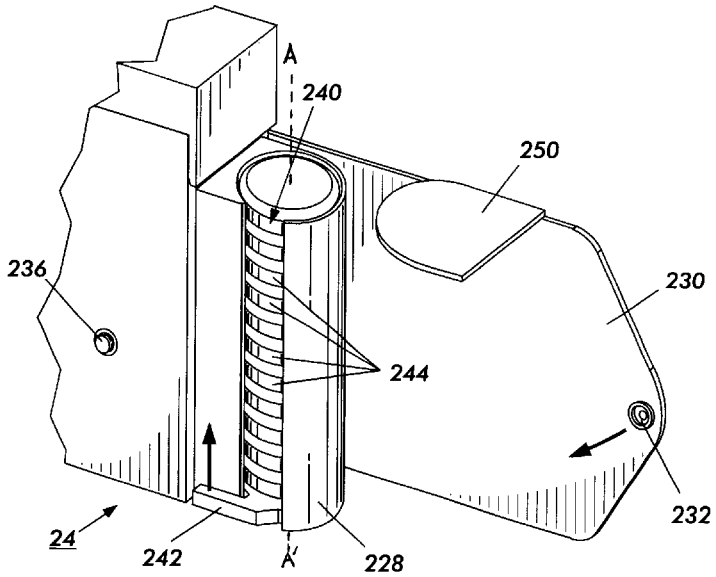
FIGS. 14 and 15 are detailed illustrations of aspects of the mint container for the embodiment depicted in FIG. 13.
Figure 15:
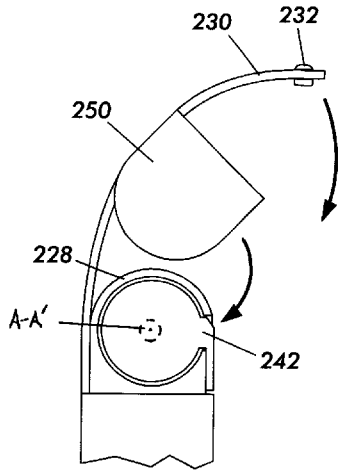

Referring now to FIGS. 13–15, depicted therein is an alternative embodiment for the combination gum and mint caddy 24, where the mint compartment 228 is generally tubular in shape and is concealed within a cover or flap 230. In the alternative embodiment, the design and construction of gum container 26 is generally consistent with that previously described with respect to FIGS. 1 and 6. However, the mint compartment 228 is primarily intended to hold and conceal a cylindrical or tubular stack of mints or candies (e.g., Certs®, Life Savers®). In one embodiment, the mint "compartment may simply be a fabric or flexible flap that is permanently affixed to one side (e.g., rear) of the gum container 26 and which releasably fastens on the opposite side (e.g., front) of the container. As depicted in FIGS. 13 and 14, flap 230 may include a snap 232 that is releasably secured to a snap base 236. By placing a cylinder-shaped roll of mints adjacent the end of the gum container 28, and closing and securing flap 230, the mints may be held in the location adjacent the gum container. It is further possible to construct the flap 230 from an elasticized fabric so as to provide for a more secure, and adjustable means for enclosing the mints. The flexible fabric could allow the use of mints having packages of varying sizes.

In yet a further alternative embodiment, the fabric from which the flap 230 is formed may completely encircle the perimeter of gum container 28 so as to provide a more aesthetically appealing gum and mint caddy. Furthermore, it is contemplated that the caddy 24 could be produced and marketed with a plurality of fabric covers so as to allow a user to select a preferred color/style.

Referring again to FIGS. 13–15, the embodiment depicted therein is one where the circular mints are stored in a mint compartment 228 that is defined by a cylindrical container having a slot or opening 240 along one side thereof. Preferably, the cylindrical mint compartment 228 is integrally formed with curved walls about a longitudinal axis A–A', which may be permanently affixed to gum container 28 so as to provide a caddy 24 having two compartments. In order to access the mints stored in compartment 228, the flap is opened, as depicted in FIG. 14, and the top of compartment 228 is exposed. Mints are preferably moved toward the top of the compartment by either inserting a portion of a finger through the slot 240 and lifting the stack, or by sliding a mint raiser 242 located at the bottom of the stack of mints 244. Preferably mint raiser 242 is a circular disk with a tab or arm that extends through slot 240 so as to allow a user to easily move the disk upward to advance the mints 244 toward the top of the compartment 228.

As depicted in FIGS. 14 and 15, the flap 230 also includes a cover or lid 250, for the mint compartment 228. When flap 230 is opened to reveal the mint compartment 228, the cover is also moved back so as to reveal the mints therein. Accordingly, cover 250 must be attached to the flap at a position spaced approximately mid-way along the flap so as to allow it to be moved back to reveal the lid.

In recapitulation, the present invention is a caddy or container for carrying gum and mints in separate compartments thereof. The caddy may be constructed of a plurality of compartments, one or more of which are separable from the other so as to allow a user to carry gum, mints or both gum and mints. The caddy includes locking, resealable lids, and an adjustable inner lid and alignment mechanism to allow the gum compartment to be used with a plurality of gum package sizes (e.g., different stick quantities). The various components of the caddy are preferably made from a plastic or similar material so as to provide durability during normal use.

It is, therefore, apparent that there has been provided, in accordance with the present invention, a multi-compartment apparatus for storing gum and mints . While this invention has been described in conjunction with preferred embodiments thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. A storage container comprising:

a first container portion including a plurality of walls and a base that define a first elongated compartment suitable for storing a plurality of stick-shaped condiments, wherein said first container portion further includes an inner lid for covering a portion of the first elongated compartment, said inner lid including an aperture to allow access to individual pieces of gum stored within the first elongated compartment;

a hinged lid for said first container, wherein said lid substantially covers a top of said first container when closed, and wherein said hinged lid is connected to said first container by a flexible hinge extending substantially along an upper edge of the first elongated compartment, said hinge being integrally formed between the lid and the upper edge of the first elongated compartment;

a second container, releasably attached to said first container, wherein said second container includes at least one wall and a base that define a second compartment suitable for storing a plurality of small items therein;

a second lid for said second container, said second lid being operatively associated with said second container so as to retain the plurality of small items within the second compartment when said second lid is closed; and a releasable attachment mechanism shared between said first and said second containers including a slide rail on an outer surface of a wall of one of said first and said second containers, a slide having engageable shoulders, on an outer surface of a wall of the other of said first and said second containers, wherein said slide rail and said slide are slideably and releasably engageable with each other.

2. The storage container of claim 1, wherein said hinged lid and upper edges of the first elongated compartment are of the same size and have mirror profiles so as to cause said hinged lid to tightly seal the first elongated compartment when closed.

3. The storage container of claim 1, wherein said first container has a clip associated therewith so as to enable the first container to be releasably connected to an article of clothing.

4. The storage container of claim 1, wherein said inner lid includes an adjustable member thereon wherein the adjustable member may be moved relative to the inner lid so as to increase the size of the aperture, thereby accommodating access to a plurality of gum package sizes stored within the first elongated compartment.

5. The storage container of claim 1, wherein said second lid is a hinged lid connected to the second container by a flexible hinge extending along a portion of an upper edge of the second compartment.

6. The storage container of claim 1, wherein at least a portion of the wall of said second container is curved about a longitudinal axis of the second compartment.

7. The storage container of claim 1, wherein the second compartment has a substantially circular cross section.

8. The storage container of claim 1, further including a fabric cover, wherein said first and second compartments are releasably affixed to one another by said fabric cover that encircles the perimeter of said first and second compartments.

9. The storage container of claim 8, wherein the first and second compartments may be removed from said fabric cover so as to allow a user to select a preferred fabric cover style.

10. The storage container of claim 1, wherein said first and second compartments are operatively attached to one another by a flexible flap extending from one edge of the first compartment, and where the flap may be closed about at least a portion of the second compartment.

11. A storage container comprising:

a first container portion including a plurality of walls and a base that define a first elongated compartment suitable for storing a plurality of stick-shaped condiments , wherein said first container further includes a vertical support for engaging an outermost piece of a plurality of sticks of chewing gum stored therein, and holding the plurality of sticks of chewing gum in a generally upright orientation;

a hinged lid for said first container, wherein said lid substantially covers a top of said first container when closed, and wherein said hinged lid is connected to said first container by a flexible hinge extending substantially along an upper edge of the first elongated compartment, said hinge being integrally formed between the lid and the upper edge of the first elongated compartment;

a second container, releasably attached to said first container, wherein said second container includes at least one wall and a base that define a second compartment suitable for storing a plurality of small items therein;

a second lid for said second container, said second lid being operatively associated with said second container so as to retain the plurality of small items within the second compartment when said second lid is closed; and a releasable attachment mechanism shared between said first and said second containers including a slide rail on an outer surface of a wall of one of said first and said second containers, a slide having engageable shoulders, on an outer surface of a wall of the other of said first and said second containers, wherein said slide rail and said slide are slideably and releasably engageable with each other.

12. The storage container of claim 11, wherein said vertical support is slidably associated with the bottom of the first elongated compartment.

13. The storage container of claim 11, wherein the vertical support is retained in one of a plurality of adjustable positions by at least one pair of protrusions extending from opposing sides of the elongated compartment.

14. A combination gum and mint storage apparatus comprising:

a gum container including an elongated rectangular compartment suitable for storing a plurality of sticks of chewing gum therein, and a lid for substantially covering a top of the elongated rectangular compartment, wherein the lid is connected to the gum container by a flexible hinge extending substantially along an upper edge of the rectangular compartment, said hinge being integrally formed between the lid and the rectangular compartment, wherein said gum container further includes an inner lid for covering a portion of the elongated rectangular compartment, said inner lid including an aperture to allow access to sticks of gum stored within the elongated rectangular compartment;

a mint container, including a second compartment suitable for storing a plurality of mints therein and a second lid for substantially covering the top of the second compartment when closed; and wherein the mint container and the gum container are releasably attached to one another by a releasable attachment mechanism shared between the mint and the gum containers including:

a slide rail on an outer surface of a wall of one of the mint and the gum containers;

a slide having engageable shoulders, on an outer surface of a wall of the other of the mint and the gum containers;

wherein the slide rail and the slide are slideably and releasably engageable with each other.

15. The apparatus of claim 14, wherein the lid and upper edges of the rectangular compartment are of the same size and have mirror profiles so as to cause the lid to tightly seal the compartment when closed.

16. The apparatus of claim 14, wherein said gum container has a clip associated therewith so as to enable the gum container to be releasably connected gay to an article of clothing.

17. The apparatus of claim 14, wherein said inner lid includes an adjustable flap wherein the flap may be withdrawn so as to increase the size of the aperture, thereby accommodating a plurality of gum package sizes.

18. The apparatus of claim 14, wherein the second lid is connected to the mint container by a flexible hinge extending along a substantial portion of an upper edge of the second compartment.

19. The apparatus of claim 14, wherein the second compartment has a substantially circular cross section.

20. A combination gum and mint storage apparatus comprising:

a gum container including an elongated rectangular compartment suitable for storing a plurality of sticks of chewing gum therein, and a lid for substantially covering a top of the elongated rectangular compartment, wherein the lid is connected to the gum container by a flexible hinge extending substantially along an upper edge of the rectangular compartment, said hinge being integrally formed between the lid and the rectangular compartment, wherein said gum container further includes a vertical support for engaging an outermost stick of the plurality of sticks of chewing gum, and holding the plurality of sticks of chewing gum in a generally upright orientation;

a mint container, including a second compartment suitable for storing a plurality of mints therein and a second lid for substantially covering the top of the second compartment when closed; and wherein the mint container and the gum container are releasably attached to one another by a releasable attachment mechanism shared between the mint and the gum containers including:

a slide rail on an outer surface of a wall of one of the mint and the gum containers;

a slide having engageable shoulders, on an outer surface of a wall of the other of the mint and the gum containers;

wherein the slide rail and the slide are slideably and releasably engageable with each other.

21. The apparatus of claim 20, wherein the vertical support is slidably connected to the bottom of the elongated rectangular compartment.

22. The apparatus of claim 20, wherein the vertical support is retained in a preferred position by at least a pair of protrusions extending from opposing sides of the elongated compartment.

* * * * *